United States Patent [19]

Rammler et al.

[11] Patent Number: 4,659,456

[45] Date of Patent: Apr. 21, 1987

[54] PROCESS OF DRYING AND HEATING OIL-CONTAINING SOLIDS

[75] Inventors: Roland Rammler, Konigstein; Hans J. Weiss; Ingo Dreher, both of Oberursel; Jorg Schmalfeld, Friedrichsdorf; Karl-Heinz Bietz, Friedberg, all of Fed. Rep. of Germany

[73] Assignee: Metallgesellschaft Ag, Frankfurt am Main, Fed. Rep. of Germany

[21] Appl. No.: 781,304

[22] Filed: Sep. 26, 1985

Related U.S. Application Data

[63] Continuation of Ser. No. 625,949, Jun. 29, 1984, abandoned.

[30] Foreign Application Priority Data

Jul. 1, 1983 [DE] Fed. Rep. of Germany ..... 3323770

[51] Int. Cl.[4] ..... C10G 1/02; C10B 53/06

[52] U.S. Cl. ..... 208/407; 208/410; 208/411; 208/427; 208/428; 201/31

[58] Field of Search ..... 208/8 R, 11 R, 407, 208/409, 410, 411, 428, 427; 201/31

[56] References Cited

U.S. PATENT DOCUMENTS

| | | | |
|---|---|---|---|
| 2,623,815 | 12/1952 | Roetneli et al. | 201/31 X |
| 2,785,115 | 3/1957 | Borch | 201/39 X |
| 3,265,608 | 8/1966 | Crawford | 208/11 R |
| 3,520,795 | 7/1970 | Schulman et al. | 208/11 R |
| 3,617,468 | 11/1971 | Reyburn | 208/11 R |
| 3,655,518 | 4/1972 | Schmalfeld et al. | 201/39 X |
| 3,884,620 | 5/1975 | Rammler | 34/57 R X |
| 3,925,190 | 12/1975 | Whitcombe et al. | 208/11 R |
| 4,210,492 | 7/1980 | Roberts | 208/8 R X |
| 4,226,699 | 10/1980 | Nutter | 208/11 R |
| 4,318,798 | 3/1982 | Albrecht et al. | 208/11 R |
| 4,332,669 | 6/1982 | Spars et al. | 208/11 R |
| 4,384,947 | 5/1983 | Van Zanten | 208/11 R |
| 4,388,173 | 6/1983 | Escher et al. | 208/11 R |
| 4,396,490 | 8/1983 | York | 208/11 R |

*Primary Examiner*—Glenn Caldarola

*Attorney, Agent, or Firm*—Karl F. Ross; Herbert Dubno

[57] ABSTRACT

Oil-containing solids are dried and heated by contacting them in a drying zone with superheated steam admitted to the zone at a temperature in excess of 200° C. The heated solids may be distilled to remove hydrocarbons therefrom and the resulting proceduce and/or combustion products of the distillation or other combustion products are used to heat a mixed vapor remainder, after separation of said carbon from the vapors formed during the drying, to the temperature of 1200° C. for recirculation to the drying zone.

10 Claims, 2 Drawing Figures

PROCESS OF DRYING AND HEATING OIL-CONTAINING SOLIDS

This is a continuation of co-pending application Ser. No. 625,949 filed on June 29, 1984, abandoned.

CROSS REFERENCE TO RELATED APPLICATION

This application is related to the commonly assigned copending application Ser. No. 581,083 filed Feb. 17, 1984 by Hans Jurgen Weiss, Roland Rammler, Helmut Hahn and Ingo Dreher and entitled "Method of and Apparatus for the Dry Distillation of Volatile Substances from Mineral Matter Containing Same", based upon a German application No. P 33 05 994.2 filed Feb. 22, 1983.

1. Field of the Invention

My present invention relates to the drying and heating of oil-containing solids and specifically oil-containing mineral matter, especially tar sands, oil sands and oil-containing diatomaceous earth (diatomite).

2. Background of the Invention

Oil-(petroleum) containing solids (especially mineral solids) are generally dried and preheated at the same time, e.g. to recover ultimately petroleum from the solids or to prepare the solids for further treatment.

Whenever drying and heating occurs at the same time, the vapor phase which is produced contains steam as well as hydrocarbon vapors which must not be discharged into the environment to ensure conformity to environmental protection rules and regulations, for the safety and health of the environment and for purely ecological reasons.

If the starting materials have substantial contents of low-boiling oils as is the case, for example, with oil-containing diatomite, the vapors evolved during the drying operation may contain hydrocarbons in substantial quantities so that a separation is required of the hydrocarbon components from the remainder of the vapor phase, if only for economic reasons.

In the past, it has been difficult to deal with drying of mineral matter containing substantial quantities of hydrocarbons without evolution of significant amounts of hydrocarbons into the environment or the use of highly complex and frequently unreliable procedures to ensure minimum release of hydrocarbons.

OBJECTS OF THE INVENTION

It is the principal object of the present invention to provide an improved method of drying and heating oil-containing mineral matter of the type described which can be carried out in a simple and economical manner without pollution of the environment.

It is also an object of the invention to provide an apparatus or plant for carrying out the improved method.

A further object of this invention is to provide a method of recovering oil and other petroleum products from oil-containing solids such as tar sands, oil-containing diatomite, utilizing a drying fluid stream, whereby disadvantages of prior art systems are obviated.

SUMMARY OF THE INVENTION

These objects and others which will become apparent herein after are attained, in accordance with the present invention, in a method of drying and heating oil-containing solids which comprises directly contacting the solids in a drying zone with superheated steam which is admitted to this zone at a temperature of at least 200° C., drying and heating the solids in this zone to form dried and heated solids and a mixed-vapor phase, separately recovering the mixed-vapor phase and the dry and heated solids from a drying zone, separating a hydrocarbon component of the mixed-vapor phase from this mixed-vapor phase, heating the remainder of the mixed-vapor phase from which the hydrocarbon component has been removed, and recycling this remainder of the mixed-vapor phase to the drying zone.

According to a feature of the invention, a partial stream of the vapors evolved during the drying step is branched off and condensed, the condensed hydrocarbons being separated from the water by a phase separation. The vapors which remain have only a low content of permanent (noncondensable) gases which enter the system mainly as air or other gases trapped in the interstitial volume of the mineral matter of feedstock and as so-called infiltrated air which may have been drawn into the drying zone or entrained into the latter with the feedstock.

After condensation of the carbons in water, the remainder of the partial stream is represented by only a relatively small quantity of this permanent gas. This small quantity of permanent gas may be discharged into the atmosphere, preferably after a further cleaning or purification treatment to ensure that all traces of hydrocarbon are removed.

Preferably this cleaning treatment should be an adsorption in which the small quantity of gas is treated with an adsorbent, such as activated carbon. Alternatively, traces of hydrocarbons or combustibles may be effectively removed by burning, e.g. flaring so that any remaining hydrocarbons are transformed into an innocuous water vapor and carbon dioxide.

While the invention is preferably utilized for the treatment of tar sands, oil sands and oil-containing diatomite, it is also applicable to the drying and preheating of bituminous materials which may be used as fuels or as sources for petroleum and hydrocarbon oils generally. Mineral matter in the latter category includes oil shale, hard coal bituminous coal, brown coal or lignite.

The dry and heated solids resulting from the drying operation previously described can then be subjected to dry distillation in the manner described, for example, in German Pat. No. 1 909 263 or in German open application DE-OS No. 29 37 065 and the corresponding U.S. Pat. Nos. 3,703,442 and 4,318,798.

This distillation can be effected at a temperature of substantially 400° to 600° C. in a process in which the solids to be subjected to dry distillation are mixed with a hot fine-grained mineral heat transfer medium. The heat transfer medium advantageously previously has been heated by a combustion process producing flue gases at a temperature of 650° to 900° C.

The solid distillation residue may, following the distillation, contain residual hydrocarbon and, as described in greater detail hereinafter, either the solid-residue hydrocarbon content or the sensible heat or the combustion heat of the flue gases or both may be used to supply the heat to the mixed vapors which are recycled to the drying zone as previously described.

A number of techniques may be used, in accordance with the invention, to heat the mixed vapors to the aforementioned temperature of at least 200° C. for recycling to the drying zone.

Firstly, we may effect an indirect heat exchange between these mixed vapors and the hot flue gas coming from either the distillation stage and the combustion mentioned in connection therewith, or with a hot flue gas which is produced specifically for this purpose by the combustion of an inexpensive and readily available fuel which may be solid, liquid or gaseous. The permanent gas left from condensation of a partial stream of the mixed vapors may be used for this combustion.

Secondly, we may effect an indirect heat exchange between the mixed vapors and the hot solid residue left from the distillation of the oil-containing solids previously dried and heated. Such carbon-containing solids residues from a distillation at a temperature of 400° to 600° C. may be heated further by a combustion process before the heat exchange, preferably by burning a part or all of any residual combustibles in this solid product.

The combustion process for producing the heat required to further heat the solid residue can be carried out in the distillation plant and can serve there to heat the circulated finely divided heat transfer medium.

However, since a part of the solid residue must always be discharged from the distillation process, the solid residue may be heated or additionally heated outside the distillation plant by a combustion process which may be supplied with additional fuel if desired. If that combustion process is effected in a fluidized-bed reactor, the reactor should contain banks of pipes through which the mixed vapors are caused to flow.

A third method of heating the mixed vapors which we may apply is the direct contact of the mixed vapors or a portion thereof with the solid residue. Such direct contact can be carried out in a pneumatic conveyor, a single-stage or multiple-stage fluidized bed apparatus, a packed column, a cyclone battery or a rotary kiln, by way of example. If the solid residue is at a temperature of, say, 550° to 900° C. in this heating operation, part or all of any residual carbon in the solid residue can be gasified under the action of hot steam. On the other hand, if the solid residue is held at comparatively low temperature of about 200° to 300° C., it will act as an adsorbent to bind part of the hydrocarbons contained in the mixed vapors. By such adsorption, the hydrocarbon content of the mixed vapors which are recirculated and also in the partial stream which is withdrawn can be limited so that it may not be necessary to condensate the water vapor which is to be discharged. In that procedure it is generally necessary to effect an additional heating of the mixed vapors after the absorption so that the mixed vapors will be at a sufficiently high temperature when they enter the drying zone.

A fourth method which we may use to effect heating of the mixed vapors utilizes a combustion process in which carbon of the carbon-containing solid distillation residue is burned to heat this residue, whereupon the heated solid residue is cooled in direct contact with cooling air. This heated cooling air and, if desired, the flue gas from the distillation plant may also be applied for indirect heating of the mixed vapors to be recycled of the drying zone. At least part of the heated cooling air or of the flue gas may be supplied at the drying zone although this can result in a higher content of the so-called permanent (non-condensable) gases in the vapors evolved in the drying. The dryer or the drying zone may be provided in or may include a vertical pneumatic conveyor in which the solids to be dried are entrained in a stream of rising drying gas and are heated by codirectional flow therewith.

Alternatively, the drying zones may consist of or can be provided in a rotary kiln or a cyclone battery. The use of a cyclone battery as a heat exchanger or effecting transfer of heat between the gas and a solid is known, for example, from U.S. Pat. No. 3,884,620.

The oil-containing solids leaving the drying zone are usually at a temperature in the range of 50° to 250° C., preferably in the range of 80° to 200° C. The drying fluid entering the drying zone is at a temperature of at least 200° C. as already noted and preferably is in the range of 200° to 750° C. and most advantageously between 300° and 800° C., inclusive.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
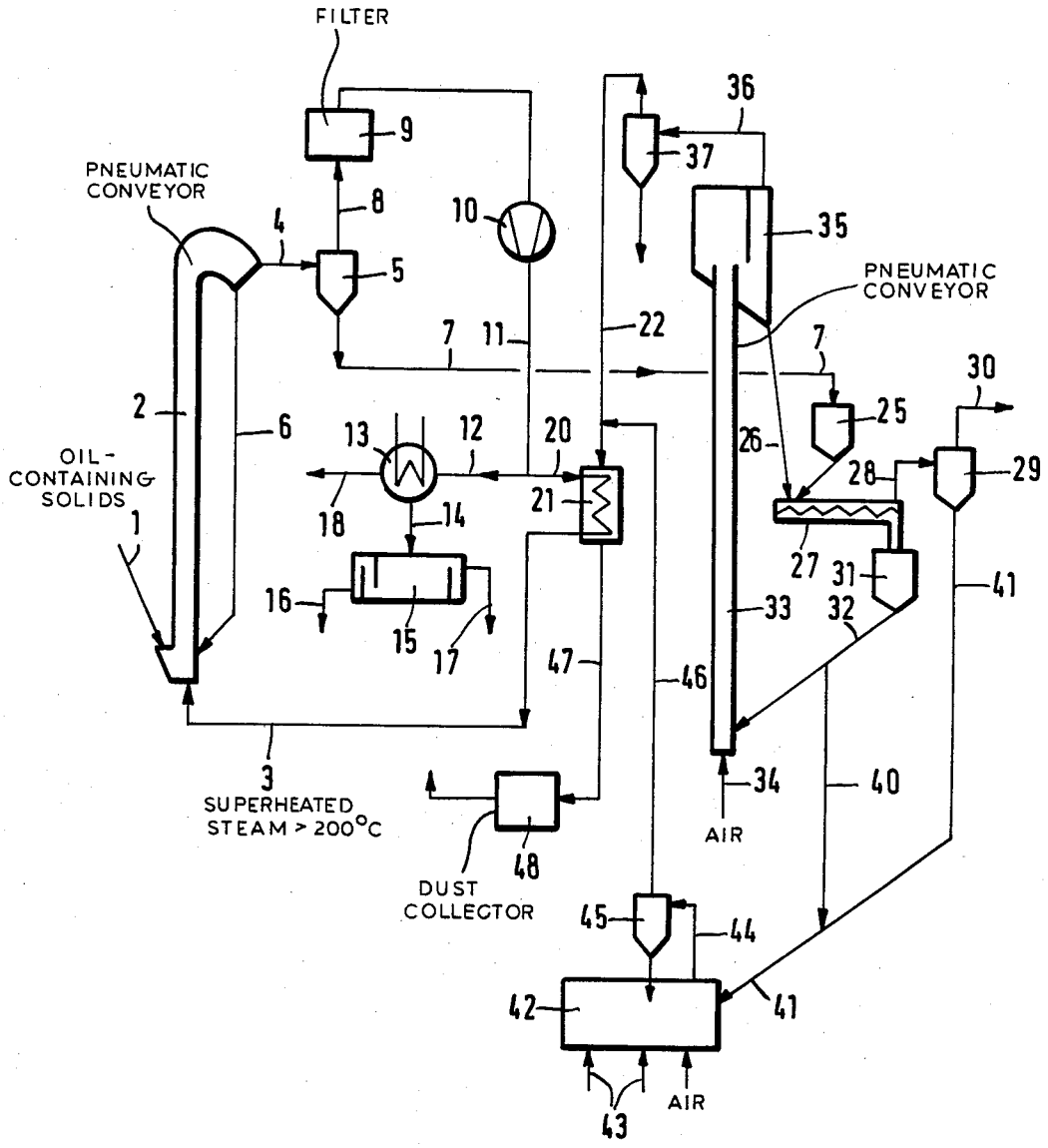
FIG. 1 is a flow diagram of a first embodiment of the process of the invention in which the mixed vapors are heated by indirect heat exchange.

In accordance with FIG. 1, the oil-containing solids to be dried are supplied in line 1 to the lower end of a pneumatic conveyor 2, in which they are upwardly entrained and heated by a drying fluid, which is supplied in line 3 and consists mainly of superheated steam. A stream consisting of the dried solids, the vapors evolved during the drying operation, and the cooled heating fluid flows in line 4 to a cyclone separator 5, in which the solids are separated from the gases and vapors. Very coarse-grained solids are recycled in the return line 6 to the entrance of the drying zone. A disintegrator, not shown, may be incorporated in the return line. That return line may alternatively constitute an integral part of the feeder (line 1).

By the conveyor 7, the dried and heated solids at a temperature in the range from 50° to 250° C., preferably from 80° to 200° C., are supplied to a distillation plant, which is known per se. The mixed vapors leaving the cyclone 5 in line 8 are first subjected to a coarse dust collection in another cyclone stage or in a filter 9 and are then forced by the blower 10 into the line 11. The steam formed by the drying operation is removed in that a partial stream of the vapors evolved in the dryer is fed in line 12 to a cooler 13, in which water vapor and the oil vapors are condensed. The condensate leaving the cooler 13 contains also hydrocarbons and is delivered in line 14 to a separating container 15, which preferably operates by gravity. Water having a higher specific gravity is withdrawn in line 16 and liquid hydrocarbons are withdrawn in line 17. In addition to condensate, permanent gases are withdrawn from the cooler 13 in line 18. Said permanent gases consist mainly of air and may possibly contain residual low-boiling hydrocarbons. In an afterpurification plant, not shown, the hydrocarbons may be eliminated by being burnt or may be recovered by being adsorbed so that a non-polluting exhaust gas is left. Because the volume of gas is small, the afterburning or adsorption equipment requires only a low expenditure.

The main part of the mixed vapors from line 11 is supplied in line 20 to a heat exchanger 21 and is heated therein to temperatures of 200° to 750° C., preferably 300° to 600° C., by means of hot gases consisting particularly of flue gas from line 22. The resulting superheated steam together with residual hydrocarbons and small amounts of permanent gases is re-used as a drying fluid and supplied in line 3 to the pneumatic conveyor 2.

The dried and heated solids are first supplied in line 7 to a storage bin 25 and are subsequently distilled in known manner. For this purpose, hot, fine-grained distillation residue from line 26 and the distillation feedstock from the bin 25 are mixed in a mixing conveyor 27 so that a mixture at a temperature in the range from 400° to 600° C. is obtained. The gaseous and vaporous products leave the mixing conveyor 27 through line 28 and for a removal of solids flow through a cycline 29 and are subsequently delivered in line 30 to a condensing plant, which is not shown and known per se. The solid distillation residue is first collected in the bin 31 and is then withdrawn through line 32. Part of the solid residue is fed to the pneumatic conveyor 33, which is supplied with heated combustion air from line 34 and, if desired, with additional fuel and in which the carbon contained in the residue is burnt. The resulting flue gases entrain the solids upwardly into the collecting bin 35. The flue gases leave the bin 35 in line 36 and are subjected to a coarse dust collection in the cyclone 37 and then flow in line 22 to the heat exchanger 21.

Part of the solids withdrawn from bin 31 are conducted in line 40 and together with the solids withdrawn from the cyclone 29 are supplied in line 41 to a solids cooler 42. The solids cooler 42 is known per se and described, e.g. in U.S. Pat. No. 4,318,798. Cooling air is supplied in line 43 to the solids cooler from below so that the solids are maintained in a fluidized state. Residual carbon may be burnt in the cooler, which is divided into different sections for that purpose. The exhaust gas from the cooler flows in line 44 to a dust-collecting cyclone 45 and is subsequently admixed in line 46 to the flue gases in line 22. The mixed hot gases deliver part of their heat in the heat exchanger 21 and then flow in line 47 to a fine dust collector 48, e.g., an electrostatic precipitator, before the gases are discharged into the atmosphere.

The energy content of the flue gases leaving the cyclone 37 is usually so high that the vapors from the dryer, which are conducted in line 20, can be adequately heated by said flue gases alone. In that case the fluidized bed cooler 42 and the gases in line 46 may be used for other purposes. If the vapors from the dryer cannot be adequately heated by waste heat, additional heat may be supplied, e.g., by means of a fuel-fired superheater.

Figure 2:
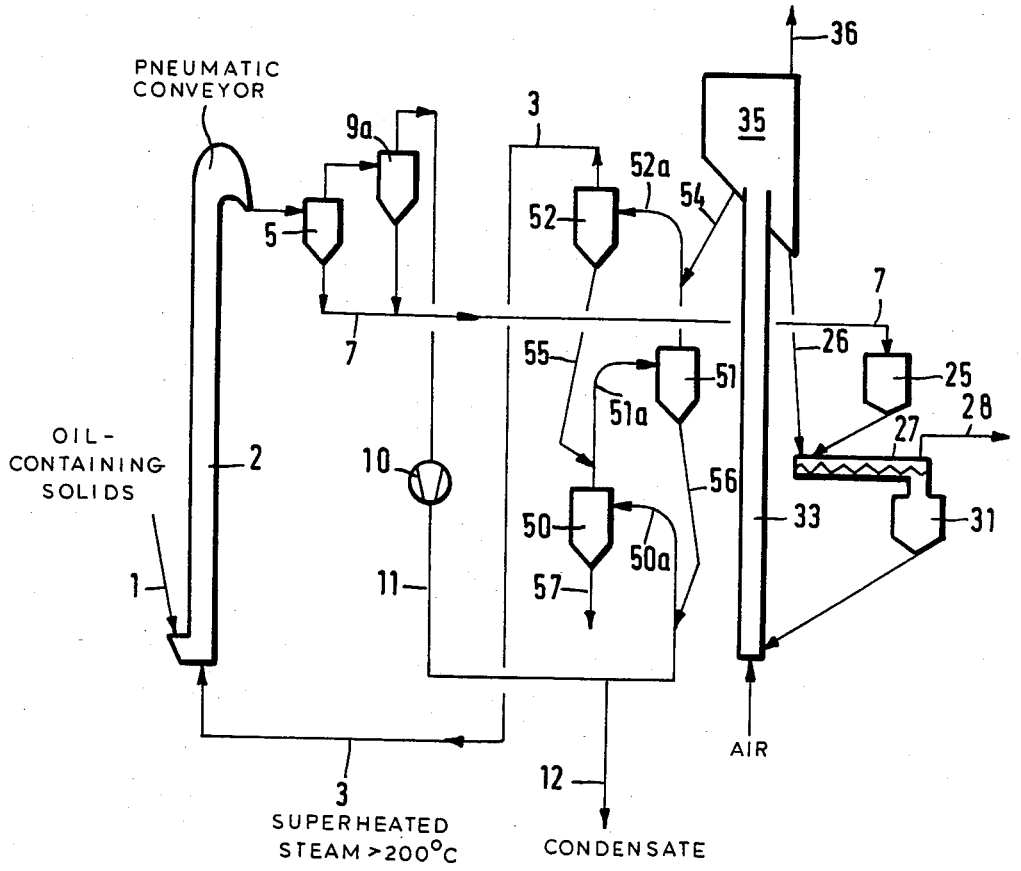
FIG. 2 is a flow diagram of a second embodiment in which the mixed vapors are heated by direct contact with the solid residue.

In the process diagrammatically shown in FIG. 2, a cyclone battery is used, in which solid residue is directly contacted with the mixed vapors. In the manner which has been disclosed with reference to FIG. 1, the mixed vapors from the drying zone 2 flow through the two cyclone separators 5 and 9*a* and are forced by the blower 10 through line 11 into the cyclone battery, which consists of three cyclone heat exchangers 50, 51, 52. A partial stream is previously branched off in line 12 so that the surplus volume is withdrawn, for instance, in the manner shown in FIG. 1. The mixed vapors are conducted from bottom to top through line 50*a*, cyclone 50, line 51*a*, cyclone 51, line 52*a* and cyclone 52 and at an elevated temperature leave the battery in line 3. Hot solid residue at about 600° to 900° C. is added from line 54 to the vapor stream in line 52*a* and is then supplied to the cyclone 52 and separated there and from line 55 is added to the vapor stream in line 51*a*, entrained to the cyclone 51 and separated there, and from line 56 is added to the vapor stream in line 50*a* and in the cyclone 50 is separated from the vapor stream and is then withdrawn in a cooled state in line 57.

The solids contained in the collecting bin 35 had previously been heated to temperatures of about 600° to 900° C. by a combustion in the vertical pneumatic conveyor 33. Thereafter, a first partial stream used as a heat transfer medium for the distillation is branched off and supplied in line 26 to the mixer 27 and a second partial stream is branched off in line 54.

The mixed vapors in line 3 have been heated to temperatures of at least 200° C. and preferably at least 300° C. and are supplied to the pneumatic conveyor 2 and used therein to dry oil-containing solids from line 1. The remaining parts of the process are carried out in accordance with the explanations given with reference to FIG. 1.

SPECIFIC EXAMPLE

In a plant like that shown in FIG. 1, a distilled oil at a rate of 65 metric tons per hour is produced by a dry distillation of moist, fine-grained diatomite, which contains 30% by weight water and is supplied at a rate of 400 metric tons per hour. The diatomite is initially dried to a residual moisture content of 5% by weight in a pneumatic dryer 2 with superheated steam as a drying and entraining fluid. Superheated steam at a rate of 525,000 $m^3$ s.t.p. is delivered by a recuperator 21 through line 3 to the conveyor 2 and enters the latter at a temperature of 435° C. In the conveyor 2, the superheated steam entrains the diatomite in an upward direction so that the moisture is evaporated to a residual content of 5% by weight. Oil at a rate of 620 kg/h is evaporated at the same time and is discharged in the mixed vapors flowing through lines 4, 8 and 11. The mixed vapors in line 11 consist of 99.5% by vol. steam, 0.2% by vol. air and 0.3% oil vapors and is at a temperature of 120° C. The additional volume which is due to the evaporation, inclusive of the permanent gases, is branched from the mixed vapors in line 12 and supplied to a condenser 13, in which water at a rate of 105 metric tons per hour and oil at a rate of 550 kg/h are recovered in a liquid phase and are subsequently separated from each other. Non-condensible gases at a rate of 850 $m^3$ s.t.p. per hour, which contain 70 kg/h oil, are de-oiled in an activated carbon adsorber and are subsequently discharged into the open. Alternatively, said gases may be added, e.g., to the combustion air for the recuperator, if the latter consists of a fuel-fired heater.

We claim:

1. A process for recovering hydrocarbons from a flowable oil-containing solid consisting essentially of tar sand, oil sand or diatomaceous earth, said process comprising the steps of:

(a) directly contacting said solid in a drying zone with superheated steam fed to said zone at a temperature of at least 200° C. to produce dried and heated solids at a temperature of 50° C. to 250° C. and a mixed vapor phase;

(b) separately withdrawing said dried and heated solids and said mixed vapor phase from said drying zone;

(c) separating a portion of said mixed vapor phase from a remainder of said mixed vapor phase;

(d) heating, at least in part by indirect heat exchange with a hot flue gas, said remainder of said mixed vapor phase to a temperature of at least 200° C. and recycling the thus-heated remainder of said mixed vapor phase substantially free from solids to said drying zone of step (a) as said superheated steam thereof;

(e) cooling said portion of said mixed vapor phase separated in step (c) in a cooling zone to produce a hydrocarbon-containing aqueous condensate and leaving a small amount of permanent gas;

(f) recovering liquid hydrocarbons from the condensate produced in step (e) in a separation zone; and (g) heating said dried and heated solids produced in step (a) to a temperature of 400° C. to 600° C. to distill off a gaseous and vaporous product which is condensed to form a hydrocarbon product, and to form a fine-grain solid residue containing carbon.

2. The process defined in claim 1, further comprising the steps of:

(h) burning the carbon in a portion of the fine-grain solid residue formed in step (g) to produce a flue gas at a temperature of 650° C. to 900° C. and a hot residue;

(i) recycling said hot residue as produced in step (h) to direct admixture with the dried and heated solids produced in step (a) to heat said dried and heated solids in step (g); and (j) feeding the flue gas produced in step (h) to step (d) for the heating of said remainder of said mixed vapor phase therein.

3. A process for recovering hydrocarbons from a flowable oil-containing solid consisting essentially of tar sand, oil sand or diatomaceous earth, said process comprising the steps of:

(a) directly contacting said solid in a drying zone with superheated steam fed to said zone at a temperature of at least 200° C. produce dried and heated solids at a temperature of 50° C. to 250° C. and a mixed vapor phase;

(b) separately withdrawing said dried and heated solids and said mixed vapor phase from said drying zone;

(c) separating a portion of said mixed vapor phase from a remainder of said mixed vapor phase;

(d) heating, at least in part by indirect heat exchange with a fine-grain solid residue having a temperature of 500° C. to 900° C., said remainder of said mixed vapor phase to a temperature of at least 200° C. and recycling the thus-heated remainder of said mixed vapor phase substantially free from solids to said drying zone of step (a) as said superheated steam thereof;

(e) cooling said portion of said mixed vapor phase separated in step (c) in a cooling zone to produce a hydrocarbon-containing aqueous condensate and leaving a small amount of permanent gas;

(f) recovering liquid hydrocarbons from the condensate produced in step (e) in a separation zone; and (g) heating said dried and heated solids produced in step (a) to a temperature of 400° C. to 600° C. to distill off a gaseous and vaporous product which is condensed to form a hydrocarbon product, and to form a fine-grain solid residue containing carbon.

4. The process defined in claim 3, further comprising the steps of:

(h) burning the carbon in a portion of the finegrain solid residue formed in step (g) to produce a flue gas at a temperature of 650° C. to 900° C. and a hot residue, at least one of said residues forming the fine-grain solid residue having a temperature of 500° C. to 900° C. used in step (d); and (i) recycling said hot residue as produced in step (h) to direct admixture with the dried and heated solids produced in step (a) to heat said dried and heated solids in step (g).

5. The process defined in claim 4, further comprising the step of:

(j) feeding the flue gas produced in step (h) to step (d) for the heating of said remainder of said mixed vapor phase therein.

6. A process for recovering hydrocarbons from a flowable oil-containing solid consisting essentially of tar sand, oil sand or diatomaceous earth, said process comprising the steps of:

(a) directly contacting said solid in a drying zone with superheated steam fed to said zone at a temperature of at least 200° C. to produce dried and heated solids at a temperature of 50° C. to 250° C. and a mixed vapor phase;

(b) separately withdrawing said dried and heated solids and said mixed vapor phase from said drying zone;

(c) separating a portion of said mixed vapor phase from a remainder of said mixed vapor phase;

(d) heating at least in part by direct contact with a fine-grain solid residue having a temperature of 500° C. to 900° C., said remainder of said mixed vapor phase to a temperature of at least 200° C. and recycling the thus-heated remainder of said mixed vapor phase substantially free solids to said drying zone of step (a) as said superheated steam thereof;

(e) cooling said portion of said mixed vapor phase separated in step (c) in a cooling zone to produce a hydrocarbon-containing aqueous condensate and leaving a small amount of permanent gas;

(f) recovering liquid hydrocarbons from the condensate produced in step (e) in a separation zone; and (g) heating said dried and heated solids produced in step (a) to a temperature of 400° C. to distill off a gaseous and vaporous product which is condensed to form a hydrocarbon product, and to form a fine-grain solid residue containing carbon.

7. The process defined in claim 6, further comprising the steps of:

(h) burning the carbon in a portion of the finegrain solid residue formed in step (g) to produce a flue gas at a temperature of 650° C. to 900° C. and a hot residue, at least one of said residues forming the fine-grain solid residue having a temperature of 500° C. to 900° C. used in step (d); and (i) recycling said hot residue as produced in step (h) to direct admixture with the dried and heated solids produced in step (a) to heat said dried and heated solids in step (g).

8. The process defined in claim 7, further comprising the step of:

(j) feeding the flue gas produced in step (h) to step (d) for the heating of said remainder of said mixed vapor phase therein.

9. The process defined in claim 7 wherein fine-grain solid residue of one of steps (g) and (h) is contacted with said remainder of said mixed vapor phase at a temperature of substantially 200° C. to 300° C. to adsorb hydrocarbons therefrom.

10. The process defined in claim 7 wherein the carbon of the solid residue is gasified by directly contacting said residue with said remainder of said mixed vapor phase at temperatures of about 550° to 900° C.

* * * * *